US009742159B1

(12) United States Patent
Niessner

(10) Patent No.: US 9,742,159 B1
(45) Date of Patent: Aug. 22, 2017

(54) SPARK PLUG FOR A GAS-POWERED INTERNAL COMBUSTION ENGINE AND METHOD FOR THE MANUFACTURE THEREOF

(71) Applicant: Federal-Mogul Ignition GmbH, Neuhaus-Schierschnitz (DE)

(72) Inventor: Werner Niessner, Steinheim (DE)

(73) Assignee: Federal-Mogul Ignition GmbH, Neuhaus-Schierschni (DE)

( * ) Notice: Subject to any disclaimer, the term of this patent is extended or adjusted under 35 U.S.C. 154(b) by 0 days.

(21) Appl. No.: 15/428,895

(22) Filed: Feb. 9, 2017

(30) Foreign Application Priority Data

Feb. 18, 2016 (DE) ..... 10 2016 102 896
Feb. 3, 2017 (DE) ..... 10 2017 102 128

(51) Int. Cl.
*H01T 13/02* (2006.01)
*H01T 13/41* (2006.01)
*H01T 21/02* (2006.01)

(52) U.S. Cl.
CPC ..... *H01T 13/41* (2013.01); *H01T 21/02* (2013.01)

(58) Field of Classification Search
CPC ..... H01T 13/41; H01T 21/02
USPC ..... 313/130, 132
See application file for complete search history.

(56) References Cited

U.S. PATENT DOCUMENTS 1,191,603 A 7/1916 Loose
1,468,539 A 9/1923 McCune
2,439,590 A 4/1948 Tognola
2,604,474 A 7/1952 Elderfield
2,069,808 A 9/1952 Bychinsky
3,956,664 A 5/1976 Rado
4,484,101 A 11/1984 Ibbott
4,851,732 A 7/1989 Kashiwara
4,954,743 A 9/1990 Suzuki
5,007,389 A 4/1991 Kashiwara
5,751,096 A 5/1998 Lahens
6,362,562 B1 3/2002 Rossi
6,495,948 B1 12/2002 Garrett
7,687,980 B2 3/2010 Kim
7,812,509 B2 10/2010 Tanaka
8,143,772 B2 3/2012 Francesconi
(Continued)

FOREIGN PATENT DOCUMENTS

AU 20122220326 A1 9/2013
DE 3736349 A1 4/1988
(Continued)

OTHER PUBLICATIONS

German Office Action for Application No. 102016102896.7 dated Sep. 30, 2016, 6 pages.

*Primary Examiner* — Vip Patel
(74) *Attorney, Agent, or Firm* — Reising Ethington, P.C.

(57) ABSTRACT

A spark plug for a gas-powered internal combustion engine, having a center conductor, an insulator surrounding the center conductor, a body surrounding the insulator, a center electrode connected in an electrically conductive manner to the center conductor, and at least one ground electrode that is connected in an electrically conductive manner to the body and forms a spark air gap with the center electrode. A shield that shields the spark air gap in the radial direction of the spark plug is located at the front end of the body. The shield includes multiple shield components that are attached to the front end of the body adjacent to one another in the circumferential direction of the spark plug.

14 Claims, 2 Drawing Sheets

(56) References Cited

U.S. PATENT DOCUMENTS

| | | | |
|---|---|---|---|
| 2006/0033411 | A1 | 2/2006 | Lindsay |
| 2013/0214668 | A1 | 8/2013 | Aochi |
| 2014/0015398 | A1 | 1/2014 | Sakakura |
| 2014/0159563 | A1 | 6/2014 | Shibata |
| 2014/0196684 | A1 | 7/2014 | Kraus |
| 2014/0285083 | A1 | 9/2014 | Hartmann |

FOREIGN PATENT DOCUMENTS

| | | | |
|---|---|---|---|
| DE | 3828805 | A1 | 3/1990 |
| DE | 112006001861 | | 8/2008 |
| DE | 102007053428 | A1 | 5/2009 |
| DE | 102013225271 | A1 | 6/2014 |
| FR | 2479588 | A1 | 10/1981 |
| WO | WO9424736 | A1 | 10/1994 |
| WO | WO2012113002 | A1 | 8/2012 |

SPARK PLUG FOR A GAS-POWERED INTERNAL COMBUSTION ENGINE AND METHOD FOR THE MANUFACTURE THEREOF

This application claims the benefit of German Application No. 10 2016 102 896.7, filed on Feb. 18, 2016, and German Application No. 10 2017 102 128.0, filed on Feb. 3, 2017, the contents of which are hereby incorporated by reference in their entirety.

FIELD

The invention generally relates to spark plugs for gas-powered internal combustion engines, and, in particular, to shielded spark plugs for stationary gas engines.

BACKGROUND

Spark plugs of this general type and methods for their manufacture are known, for example from WO 2012/113002 A1. Shields located at the front end of the spark plug are used to calm the flow of the combustion gas/air mixture in the region of the spark air gap or the spark gap between the electrodes, and thereby improve ignition of the combustion gas/air mixture. The prior art shields are made from tubes or tube sections in order to achieve the best possible shielding in the circumferential direction of the spark plug.

SUMMARY

It is an object of the present application to simplify the manufacture of a spark plug of the type mentioned at the outset.

A spark plug according to one embodiment has a center conductor, an insulator surrounding the center conductor, and a spark plug body surrounding the insulator. Located at the front end of the body is a thread for screwing into the internal combustion engine. The spark plug has a center electrode that is connected in an electrically conductive manner to the center conductor and that in particular projects out of the front end of the insulator. The spark plug has at least one ground electrode that is connected in an electrically conductive manner to the spark plug body and forms a spark air gap with the center electrode. The ground electrode can in particular be designed in the form of a front electrode, so that the spark air gap is formed with the end face of the center electrode. Located at the front end of the body is a shield that shields the spark air gap in the radial direction of the spark plug and is composed of multiple shield components separated from one another. The shield components are attached, in particular welded, to the front end of the spark plug adjacent to one another in the circumferential direction of the spark plug. Any two adjacent shield components are separated from one another by a gap.

In a method for manufacturing a spark plug, in particular with the aforementioned features, a shield that shields the spark air gap in the radial direction in operation is welded onto the front end of the body. According to one embodiment, the shield is composed of multiple shield components. The shield components are made from sections of a semifinished wire product, which in particular is provided from a supply roll. One end of the semifinished wire product is welded onto the front end of the body, in particular by resistance welding. The semifinished wire product is then severed at a specific distance from the front end of the body. A section of the semifinished wire product that forms a shield component, which in particular can extend in the longitudinal direction of the spark plug, is then located at the front end of the body. The end of the semifinished wire product created by the preceding severing operation is then welded to the front end of the body next to, and at a specified distance from, the shield component that is already fastened to the front end of the body. Next, the semifinished wire product is once again severed at a specific distance from the front end of the body. There are now two shield components made from sections of the semifinished wire product located adjacent to one another on the front end of the body. The steps of welding and severing of the semifinished wire product are repeated along the circumference of the body until a shield composed of multiple shield components attached to the body is formed that surrounds the spark air gap of the spark plug in its circumferential direction. In this process, the weld attachment position for the semifinished wire product is chosen in each case such that the semifinished wire product does not touch a semifinished wire product already attached to the body, and after the welding and severing of the semifinished wire product, any two adjacent sections of the semifinished wire product are separated from one another by a gap.

Some embodiments may have one or more of the following advantages:

An adequate shielding effect can be achieved, even though each of the narrow gaps between the individual shield components interrupts the shield in the circumferential direction.

The spark plug has less of a tendency toward undesired pre-ignition, which occurred relatively frequently with the prior art shields made of tube sections. Good flow smoothing of the combustion gas/air mixture in the region of the spark air gap can be achieved.

One or more embodiments can be very easy to manufacture, since the shield components can be manufactured from the same semifinished wire product as the ground electrode.

Moreover, the welding on of the shield components can be carried out very easily, since it is possible to use the same production equipment that is used in any case to weld on the ground electrode, which is likewise made of a semifinished wire product.

The gap between the individual shield components allows very easy attachment of the individual wire sections by resistance welding. The welding current flows in a defined manner from the semifinished wire product through its contact area with the body and into the body, achieving good attachment. There are no leakage currents through the adjacent shield components that are already attached to the body.

In implementing one or more embodiments, the spark plug body can have at its the front end an end face that is perpendicular to the center conductor, to which end face the shield components or the ends of the semifinished wire product are welded. The semifinished wire product here can in particular be welded by its end face to the end face of the body. The lengths of the shield components in the axial direction of the spark plug can match. It is possible for only the section of the semifinished wire product that later forms the ground electrode to be severed at a greater distance from the front end of the body. The longer section of the semifinished wire product can be bent over, thus forming the ground electrode. The cross-sections of the shield components and of the ground electrode—viewed in a cross-section through the spark plug—can match in shape and size. The gap between two adjacent shield components can extend in the axial direction of the spark plug starting from the end face of the body. The shield can be composed of two to six, in particular four to six, or more particularly six, shield components.

In another implementation, during manufacture of the spark plug the body can be rotated through a specific angle about its longitudinal axis after each severing of the semifinished wire product and before the next welding step. The manufacturing process can be simplified further in this way, since the semifinished wire product is always fed at the same position, while the body is rotated a little further each time after a shield component is welded on. The semifinished wire product can then be moved forward in the longitudinal direction once again until its end face contacts the end face of the body.

In another implementation, each of the shield components can have longitudinal edges extending in the axial direction of the spark plug and a pair of major sides and a pair of minor sides, of which at least the longitudinal edges facing radially outward are rounded (i.e., along the outer major side). The cross-section of the semifinished wire product is then not exactly rectangular, but instead can have a radius on two of its longitudinal edges. A rounding of the outward-facing longitudinal edges of the shield components makes it possible to reduce the gap between two adjacent shield components and improve the shielding effect without impeding the screwing of the spark plug into the internal combustion engine.

DRAWINGS

Additional advantages and features may arise from the description below of an exemplary embodiment in conjunction with the figures. In the figures.

DESCRIPTION

Figure 2:
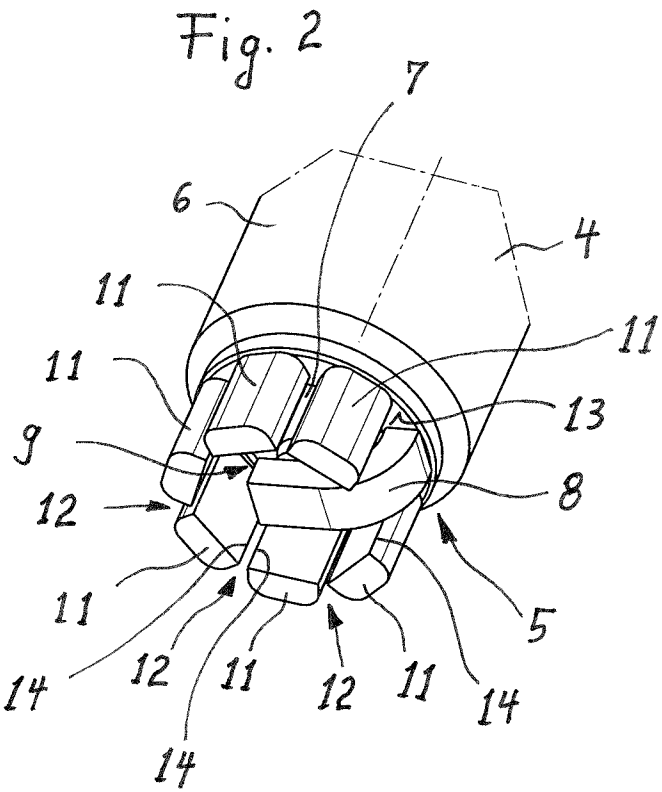
FIG. 2 is an enlarged view of the front end of the spark plug from FIG. 1.
Figure 1:
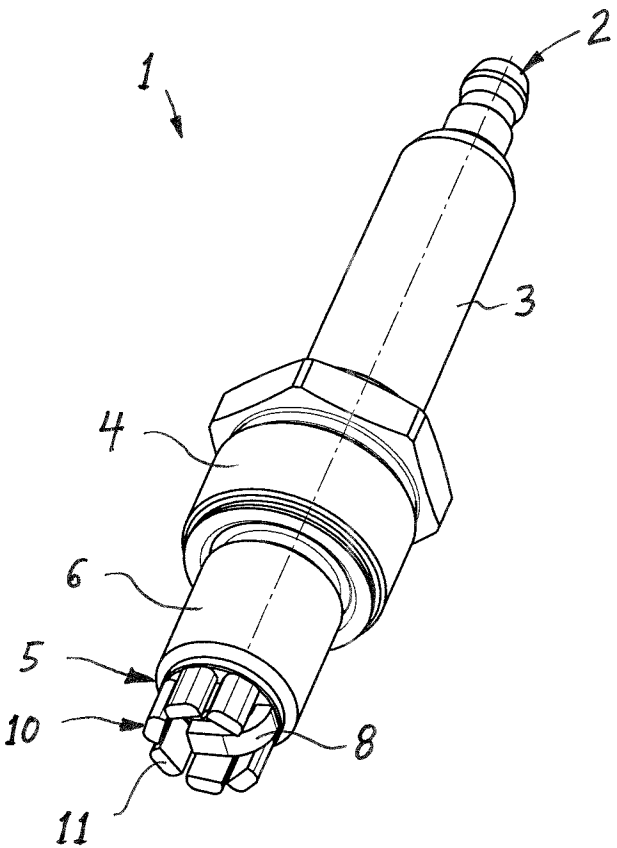
FIG. 1 is a perspective view of a spark plug.

FIGS. 1 and 2 show a spark plug 1 for a gas-powered stationary internal combustion engine. The spark plug 1 has a center conductor 2, an insulator 3 surrounding the center conductor 2, and a body 4 surrounding the insulator 3. The body 4 has a front end 5 at which is located a thread 6 for screwing the spark plug 1 into the internal combustion engine. On the side facing away from the front end 5, the insulator 3 projects out of the body 4, and the center conductor 2 projects out of the insulator 3. A line (not shown) for supplying the spark plug 1 with an ignition voltage can be connected in a known manner to the end of the center conductor 2 projecting from the insulator 3. The spark plug 1 has a center electrode 7 that is connected in an electrically conductive manner to the center conductor 2, and has at least one ground electrode 8 that is connected in an electrically conductive manner to the body 4 and forms a spark air gap 9 with the center electrode 7.

Located at the front end 5 of the body 4 is a shield 10 that shields the spark air gap 9 in the radial direction of the spark plug 1. The shield 10 includes multiple shield components 11. The shield components 11 are made from sections of a semifinished wire product. Any two adjacent shield components 11 are separated from one another by a gap 12. The gap 12 between the shield components 11 is tapered toward the spark air gap 9. At its front end 5, the body 4 has an end face 13 that is perpendicular to the center conductor 2 and to which the shield components 11 are welded. In the enlarged representation in FIG. 2, the center electrode 7 projecting out of the insulator 3 at the front end 5 is partially visible through a gap 12 between two shield components 11.

Figure 3:
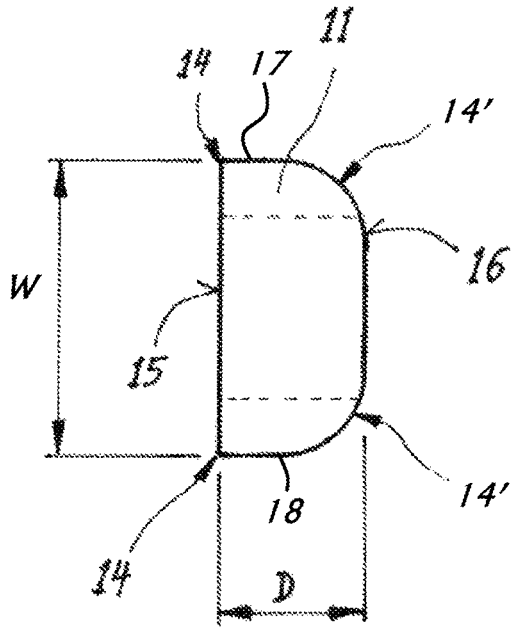
FIG. 3 is a cross-sectional view of a shield component from the spark plug of FIGS. 1 and 2.

In the illustrated embodiment, each shield component 11 is straight and extends in a direction that is parallel to an axis A of the spark plug 1. Each shield component 11, in cross-section, includes a pair of major sides 15, 16 and a pair of minor sides 17, 18. For clarity purposes, the major and minor sides of only one of the shield components 11 are identified in FIG. 2 and shown more clearly in the cross-sectional view of the shield component 11 in FIG. 3. Each shield component 11 has a width W and a depth D, as shown in FIG. 3. In this embodiment, the major sides 15, 16 are parallel to one another. The major sides 15, 16 are perpendicular to a radius of the spark plug (i.e., tangential to at least a portion of the body 4) and include an inner major side 15 and an outer major side 16. The inner major side 15 is closer to the spark air gap 9 and is wider than the outer major side 16. This creates smaller, or tapered gaps 12 between adjacent shield components 11 at inner major sides 15 than outer major sides 16. At least one way to achieve this configuration involves the inclusion of sharp-edged longitudinal edges 14 between the inner major side 15 and the pair of minor sides 17, 18 and round-edged longitudinal edges 14' between the outer major side 16 and the pair of minor sides 17, 18. The round-edged longitudinal edges 14' may be chamfered, curved, or more particularly, concavely curved, radiused and/or have some other type of rounded off configuration. Except for a gap to accommodate the ground electrode 8, the plurality of shield components 11, which includes six shield components in the illustrated embodiment, completely circumferentially surround the center electrode 7 to influence the flow of an air/fuel mixture from the side. The shield components 11 are not designed to act as sparking electrodes.

During the manufacture of the spark plug 1, the semifinished wire product is unrolled from a supply roll and fed to the body 4, which is held in a defined position. One end of the semifinished wire product is fed to the end face 13 and is placed thereon. Next, the end of the semifinished wire product is welded to the end face 13 by resistance welding in that a current is passed through the semifinished wire product and the body 4. The semifinished wire product is now severed at a specific distance from the end face 13 so that a section of the semifinished wire product that is attached to the body 4 forms a shield component 11 at the front end 5. The body 4 is now rotated through a specific angle about its longitudinal axis. Next, the end of the semifinished wire product produced by the preceding severing operation is advanced until it reaches the end face 13. The angle through which the body 4 is rotated is chosen such that the semifinished wire product can be fed next to the shield component 11 that is already attached there, with a narrow gap 12 remaining between the two that prevents the welding current in the subsequent welding on of the semifinished wire product from flowing laterally into the adjacent shield component 11. The gap 12 thus ensures that, during resistance welding of the semifinished wire product, the welding current flows through the end face 13 into the body 4, and that a secure connection is created there. Next, the semifinished wire product is severed at the same distance from the end face 13 so that another section of the semifinished wire product attached to the body 4 forms a second shield component 11 on the front end 5. The two shield components 11 are parallel and are of equal length. In addition, a gap 12 is located between them that extends in the axial direction of the spark plug 1 starting from the end face 13 over the entire length of the shield components 11. The two adjacent shield components 11 are thus completely separated from one another by the gap 12.

The steps of rotating the body 4 and of welding and severing of the semifinished wire product are repeated along the circumference of the body 4 until a complete shield 10 composed of multiple shield components 11 attached to the body 4 is formed that surrounds the spark air gap 9 in the circumferential direction of the spark plug 1. In the exemplary embodiment shown, this is ensured by six shield components 11 and one ground electrode 8 that is made from the same semifinished wire product as the shield components 11 and is welded to the end face 13 in the same manner by means of resistance welding. To form the ground electrode 8, the semifinished wire product is severed at a greater distance from the end face 13 after being welded on, however. After that, the ground electrode 8 is bent over in the direction of the center electrode 7 to form the spark air gap 9 therewith.

The semifinished wire product has an approximately rectangular cross-section, wherein its longitudinal edges 14' can be rounded to different degrees. At least the longitudinal edges 14' of the shield components 11 facing radially outward (i.e., on either side of the outer major side 16) are—as is evident in the figures—rounded, while the longitudinal edges 14 facing radially inward (i.e., on either side of the inner major side 15) are relatively sharp-edged. This embodiment has the advantage that, firstly, the relatively narrow gap 12 between two adjacent shield components 11, formed by the radially inward-facing longitudinal edges 14 of the shield components 11, can be ensured so that good shielding action is achieved. The radial space requirement of the shield components 11 is reduced by the rounded outer longitudinal edges 14' of the shield components 11, since they do not project radially outward as far and do not impede the screwing of the thread 6 into the associated internal thread of the internal combustion engine. Moreover, with the rounded outer longitudinal edges 14', the outer diameter defined by the shield components 11 can be minimized, and the shield components 11 do not extend beyond the diameter of the body 4. This is advantageous in that it allows an increase in the width of the shield component without changing the pre-defined dimensions of the ring-shaped face of the body. For a given number of shield components, the width of the gap 12 between two shield components can be reduced. The width of the shield components 11 can be increased by more than about 20% without interfering with its installation in an internal combustion engine.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMBERS

1 spark plug
2 center conductor
3 insulator
4 body
5 front end
6 thread
7 center electrode
8 ground electrode
9 spark air gap
10 shield
11 shield components
12 gap
13 end face
14 longitudinal edges
15 inner major side
16 outer major side
17 minor side
18 minor side

The invention claimed is:

1. A spark plug for a gas-powered internal combustion engine, comprising a center conductor, an insulator surrounding the center conductor, a body surrounding the insulator, a thread arranged at the front end of the body for screwing into the internal combustion engine, a center electrode connected in an electrically conductive manner to the center conductor, and at least one ground electrode that is connected in an electrically conductive manner to the body and forms a spark air gap with the center electrode, wherein a shield that shields the spark air gap in the radial direction of the spark plug is located at the front end of the body, wherein the shield includes a plurality of shield components that are attached to the front end of the body adjacent to one another in the circumferential direction of the spark plug, wherein each shield component includes a pair of major sides with an inner major side and an outer major side, and a pair of minor sides, the inner major side and the outer major side are parallel to one another with the inner major side being closer to the spark air gap and wider than the outer major side, wherein the pair of major sides are perpendicular to a radius of the spark plug.

2. The spark plug according to claim 1, in which the shield components are welded to an end face that is perpendicular to the center conductor at the front end of the body.

3. The spark plug according to claim 2, in which the gap between two adjacent shield components extends in the axial direction of the spark plug starting from the end face of the body.

4. The spark plug according to claim 1, in which the shield is composed of six shield components.

5. The spark plug according to claim 1, in which each of the shield components has longitudinal edges extending in the axial direction of the spark plug, of which the longitudinal edges between the outer major side and the minor sides facing radially outward are rounded.

6. The spark plug of claim 5, wherein the longitudinal edges between the inner major side and the minor sides facing radially inward are sharp-edged.

7. The spark plug according to claim 1, in which the cross-sections of each shield component and of the at least one ground electrode match in terms of shape and size.

8. The spark plug according to claim 1, wherein each shield component is straight and extends in a direction that is parallel to an axis A of the spark plug.

9. The spark plug according to claim 1, wherein at least two shield components are separated by a gap that is tapered toward the spark air gap so that the gap is wider at the outer major side of each shield component and narrower at the inner major side of each shield component.

10. A spark plug for a gas-powered internal combustion engine, comprising a center conductor, an insulator surrounding the center conductor, a body surrounding the insulator, a center electrode connected in an electrically conductive manner to the center conductor, and at least one ground electrode that is connected in an electrically conductive manner to the body and forms a spark air gap with the center electrode, wherein a shield that shields the spark air gap in the radial direction of the spark plug is located at the front end of the body, wherein the shield includes a plurality of shield components that are attached to the front end of the body, wherein each shield component includes a pair of major sides, with an inner major side and an outer major side, a pair of minor sides, outer longitudinal edges between the pair of minor sides and the outer major side, at least one of the outer longitudinal edges is round-edged, and inner longitudinal edges between the pair of minor sides and the inner major side, at least one of the inner longitudinal edges is sharp-edged, the inner major side is closer to the spark air gap and is wider than the outer major side, wherein the plurality of shield components surround the spark air gap.

11. A method for manufacturing a spark plug for a gas-powered internal combustion engine with a center conductor, an insulator surrounding the center conductor, a spark plug body surrounding the insulator, a thread arranged at the front end of the body for screwing into the internal combustion engine, a center electrode connected in an electrically conductive manner to the center conductor, and at least one ground electrode that is connected in an electrically conductive manner to the spark plug body and forms a spark air gap with the center electrode, in which a shield that shields the spark air gap in the radial direction is welded onto the front end of the body, wherein the shield is composed of multiple shield components comprising sections of a semifinished wire product, the method comprising the steps of:

welding one end of the semifinished wire product onto the front end of the body;

severing the semifinished wire product so that a section of the semifinished wire product attached to the body forms a shield component at the front end of the body, the section of the semifinished wire product having an end;

welding the end of the semifinished wire product created by the preceding severing operation to the front end of the body next to the shield component that is already fastened to the body;

severing the semifinished wire product so that another section of the semifinished wire product attached to the body forms an additional shield component at the front end of the body; and repeating the steps of welding and severing the semifinished wire product along the circumference of the body until a shield composed of multiple shield components attached to the body is formed that surrounds the spark air gap of the spark plug in its circumferential direction.

12. The method according to claim 11, in which the at least one ground electrode is made from the same semifinished wire product as the shield.

13. The method according to claim 11, in which the body is rotated through a specific angle about its longitudinal axis after each severing of the semifinished wire product and before the next welding step.

14. The method according to claim 11, in which the semifinished wire product is welded by its end face to an end face that is perpendicular to the center conductor at the front end of the body (4).

* * * * *